United States Patent [19]

Waibel

[11] Patent Number: 4,559,877

[45] Date of Patent: Dec. 24, 1985

[54] CORNER WORK TABLE, IN PARTICULAR FOR OFFICE WORK

[76] Inventor: Walter Waibel, Schwaiger Str. 34, D-8312 Dingolfing, Fed. Rep. of Germany

[21] Appl. No.: 526,089

[22] Filed: Aug. 24, 1983

[30] Foreign Application Priority Data

Aug. 27, 1982 [DE] Fed. Rep. of Germany ..... 3232017

[51] Int. Cl.[4] ..... A47B 57/00

[52] U.S. Cl. ..... 108/64; 108/151; 312/238

[58] Field of Search ..... 108/59, 64, 151; 312/239, 223; 248/440.1, 188.1, 163.1

[56] References Cited

U.S. PATENT DOCUMENTS

| | | | |
|---|---|---|---|
| 1,796,176 | 3/1931 | Witzleb | 248/163.1 |
| 1,930,741 | 10/1933 | DeSaussure, Jr. | 108/64 |
| 2,872,966 | 2/1959 | Chamness | 248/188.1 X |
| 3,026,079 | 3/1962 | Stack | 248/188.1 X |
| 3,342,147 | 9/1967 | Shettles | 108/64 |
| 3,447,491 | 6/1969 | Noren | 108/64 |
| 3,511,192 | 5/1970 | Noren | 108/64 |
| 3,521,579 | 7/1970 | Stafford | 108/64 |
| 4,094,561 | 6/1978 | Wolff et al. | 312/223 |
| 4,323,291 | 4/1982 | Ball | 312/196 |

FOREIGN PATENT DOCUMENTS

| | | | |
|---|---|---|---|
| 958506 | 2/1957 | Fed. Rep. of Germany | 108/64 |
| 970253 | 1/1951 | France | 108/151 |

*Primary Examiner*—James T. McCall

*Attorney, Agent, or Firm*—Thomas R. Vigil

[57] ABSTRACT

The invention relates to corner work table (1), in particular for office work, comprising a subframe (2) and a corner table top (3). The table top has the form of a circular segment, the radius sides being formed as connection sides (5,6) to further adjoinable table tops (17,18). The securing is effected by edge-side angle rails (34) and by openings in a support tube (11), into which the support arms (33,41) are insertable. The subframe (2) comprises a floor-side stirrup member (8) to which four support legs (9,10,14,15) are attached on which support tubes (11,16) are secured which in turn carry the corner table top (3). This subframe structure provides a high stability and firmness of the corner work table (1) and due to the form of the member (8) open towards the wide side of the corner work table a large degree of foot freedom for the user. For lowering a table top (17) compared with the height of the corner table top (3) a support plate is further proposed with support arms (40) secured thereto, said arms (40) engaging below and supporting the table top (17). It is achieved with the corner work table (1) shown that with adjoining table tops (17,18) the latter are supported at the joints by the subframe (2) of the corner table (1).

42 Claims, 8 Drawing Figures

Figure 1:
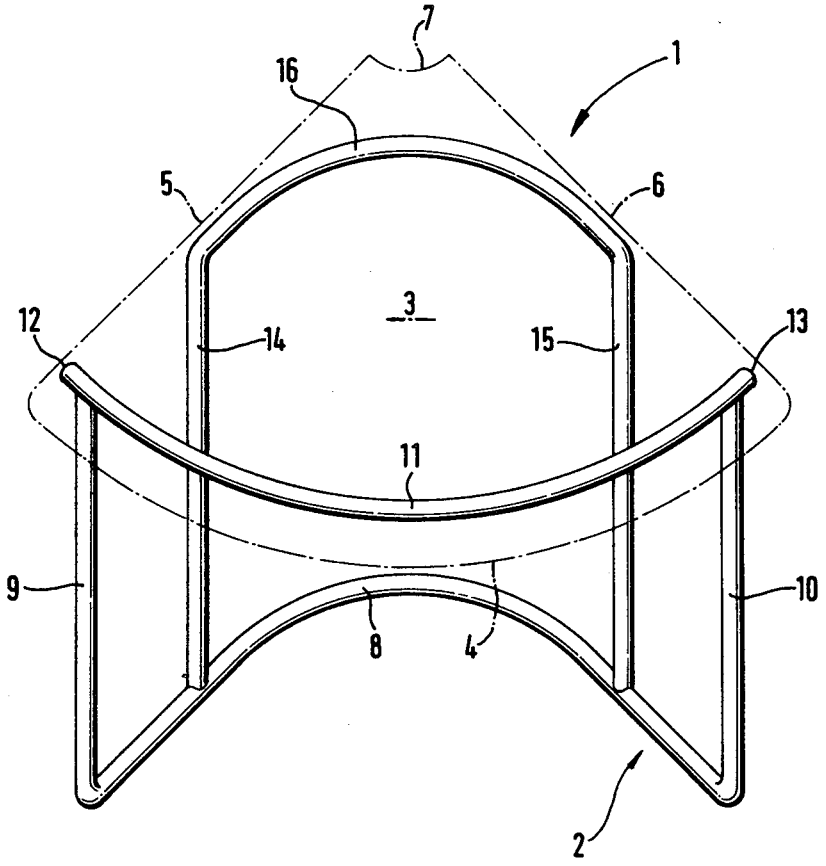

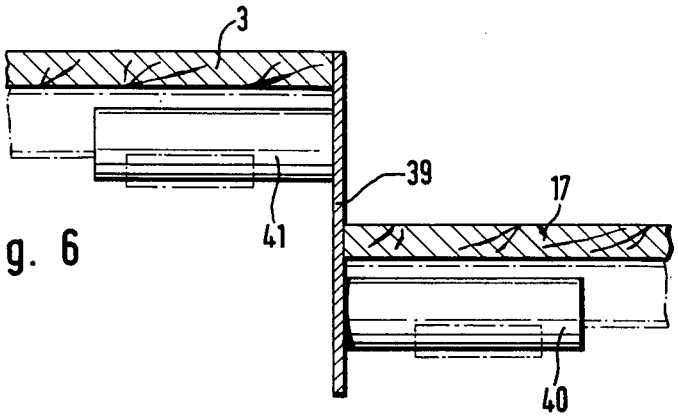
Fig. 6
Fig. 7
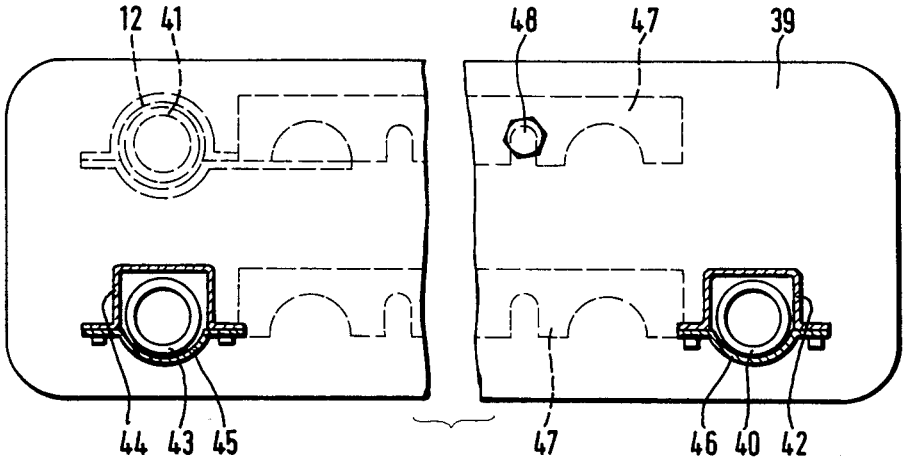
Fig. 8
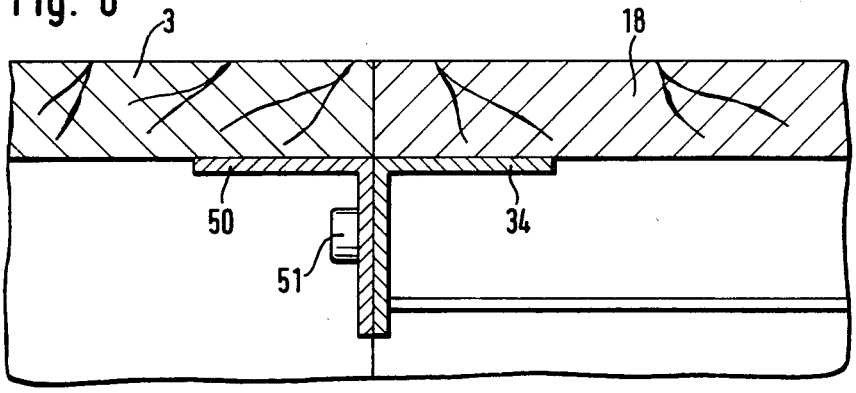

CORNER WORK TABLE, IN PARTICULAR FOR OFFICE WORK

The invention relates to a corner work table, in particular for office work, according to the preamble of claim 1.

It is often expedient and desirable to assemble desks or longer conference table arrangements in L or U-form. For this purpose it is known to place together two work tables with the vertical side edges facing the user and to cover the space remaining in the extension of the work tables with a corner table top. The corner table top is secured with angle members to the two work tables. This structure requires a relatively long assembly time and usually gives a corner element between the work tables which is not very stable and cannot be subjected to much load.

Further individual tables are known whose table top has the form of an equilateral triangle. These tables consist of a rigid frame, likewise in the form an equilateral triangle with support legs at the triangle corners. On the frame the table top is secured. Depending on how the individual tables are put together, this table form makes it possible to obtain long table rows, L-shaped, U-shaped and ring-shaped table arrangements. However, in this case the tables are only placed together so that relatively large troublesome gaps occur between the adjacent table tops. In addition, due to the placing together of the individual work tables two support legs come to lie adjacent each other and restrict and obstruct the foot movement beneath the table tops. Due to the triangle form which is necessary here to assemble larger table formations sharp edges necessarily arise which firstly represent a danger of injury and secondly do not have an attractive appearance. Particularly when assembling longer table rows the end face terminates inclined to the total assembled table top and in an acute angle. This type of work table is therefore suitable for rapid assembly, for example in hotel service rooms, etc., but not very expedient for use in offices.

In comparison, the object of the invention is to provide a corner work table, in particular for office work, with good stability and firmness, which is suitable for assembling continuous L and U-shaped work table arrangements, in particular of conference tables and desks.

This object is achieved with the characterizing features of claim 1.

According to claim 1 the corner table top has the form of a circular segment having two straight radius sides and an arc side and is supported by a special subframe. The circular segment form of the corner table top gives a pleasant appearance and eliminates any danger of injury. By constructing the subframe with a connecting member which connects the support legs and is open towards the circular arc side of the table top said subframe is well stiffened, with the corner table top itself contributing to the stability. The open connecting member does not restrict the foot freedom on sitting at the outside of the corner table top, for example after assembling a large conference table. Since the corner work table has its own stable subframe a stable assembled table construction can be achieved simply by connecting adjoining table tops to the subframe or the corner table top and independent support means of the adjoining table tops in the vicinity of the subframe of the corner table top can be dispensed with. This avoids a double supporting at the joints and advantageously increases the free foot room in this area.

The corner work table is to be regarded as an element for assembling L or U-shaped larger table arrangements, but can however, because it has its own subframe, also be set up and used on its own and independently of adjoining table tops.

In a preferred embodiment, along the radius or assembly sides of the corner table top angle rails flush with said sides are disposed which serve both to stiffen the corner table tops and as support and securing elements for attached further table tops.

The subsidiary claims relate to expedient further developments of the subject of the main claim.

Figure 2:
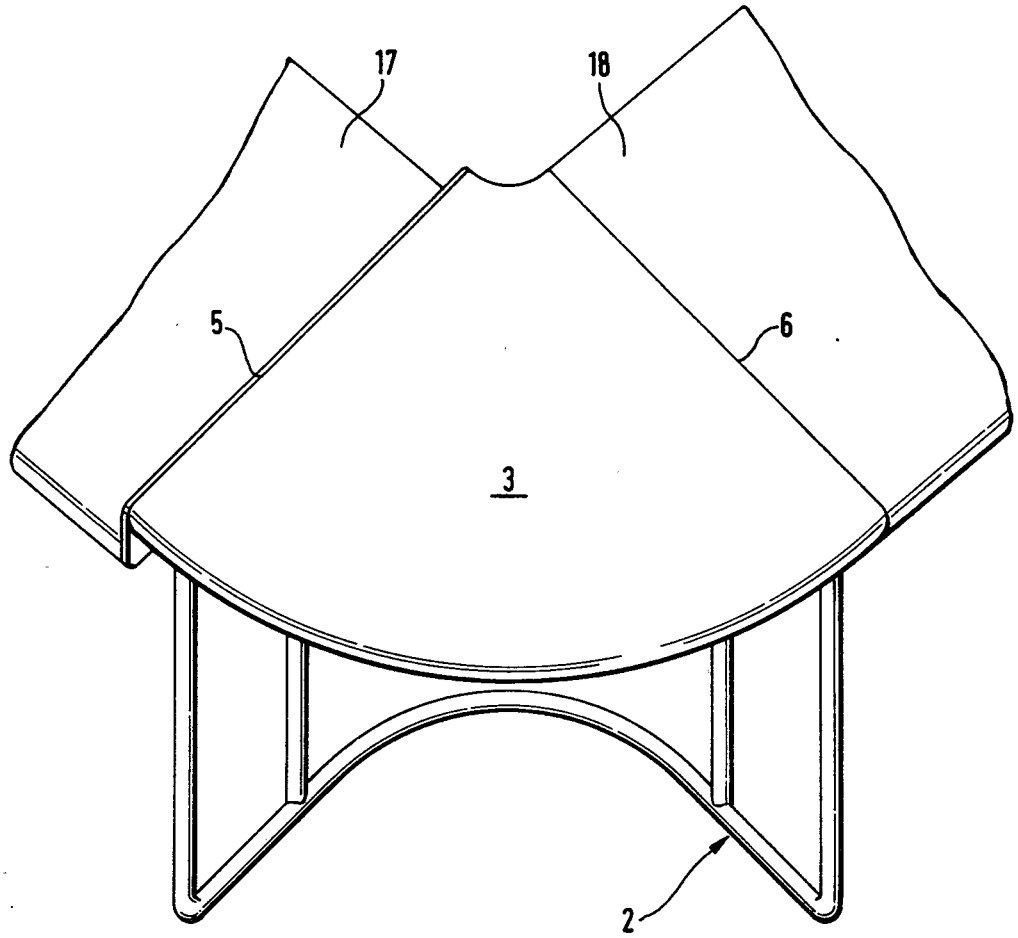
Figure 3:
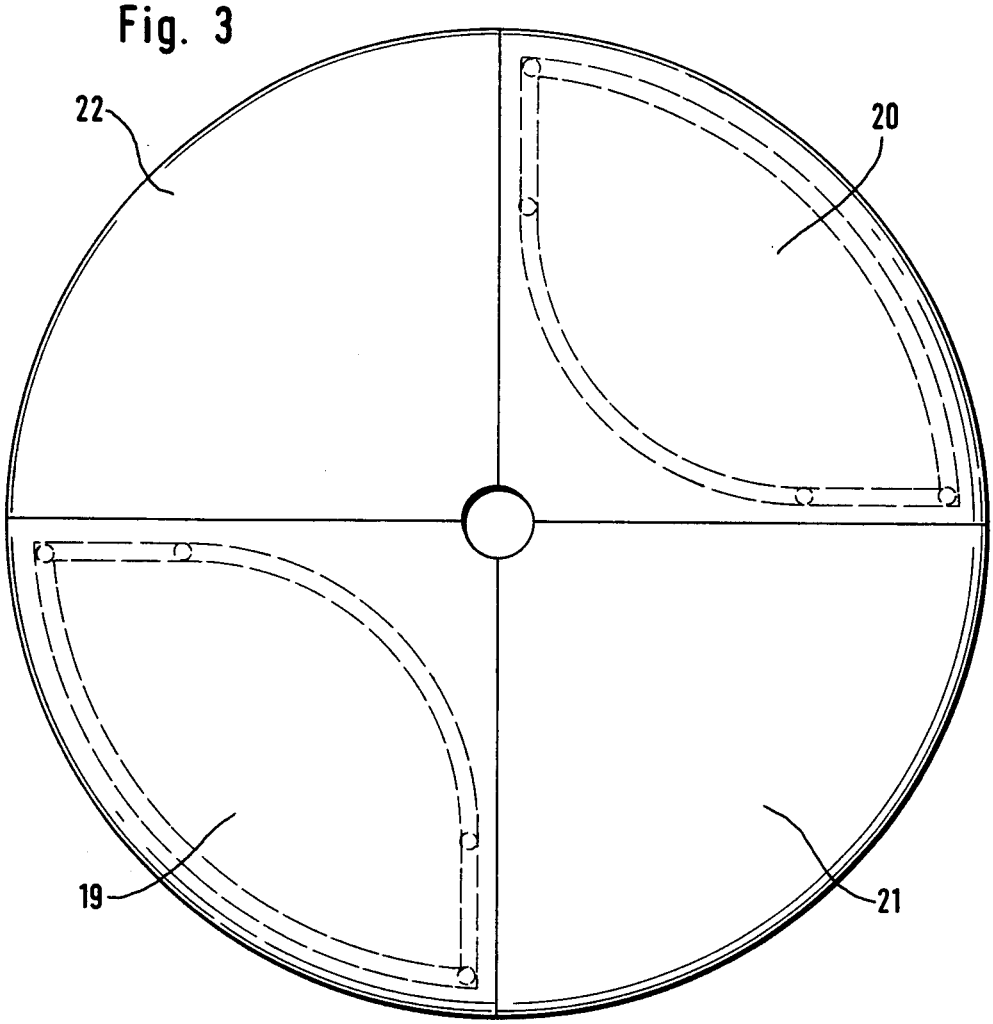
Figure 4:
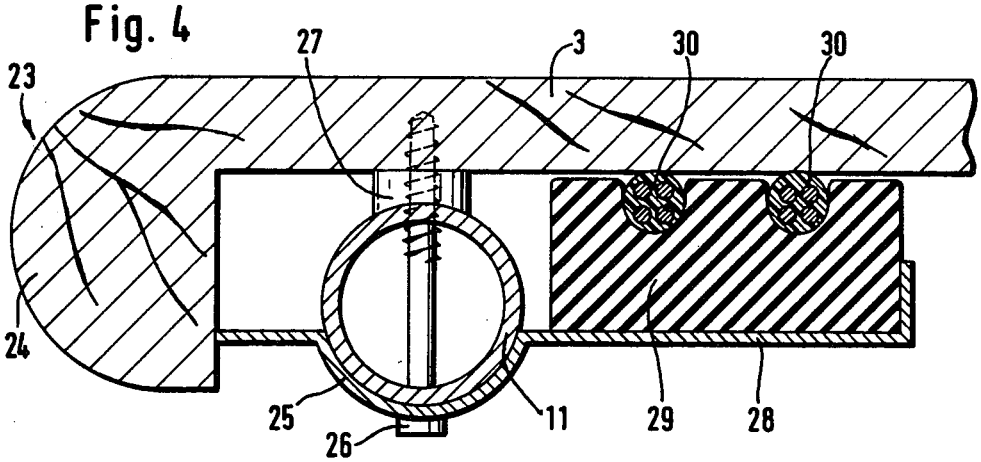
Figure 5:
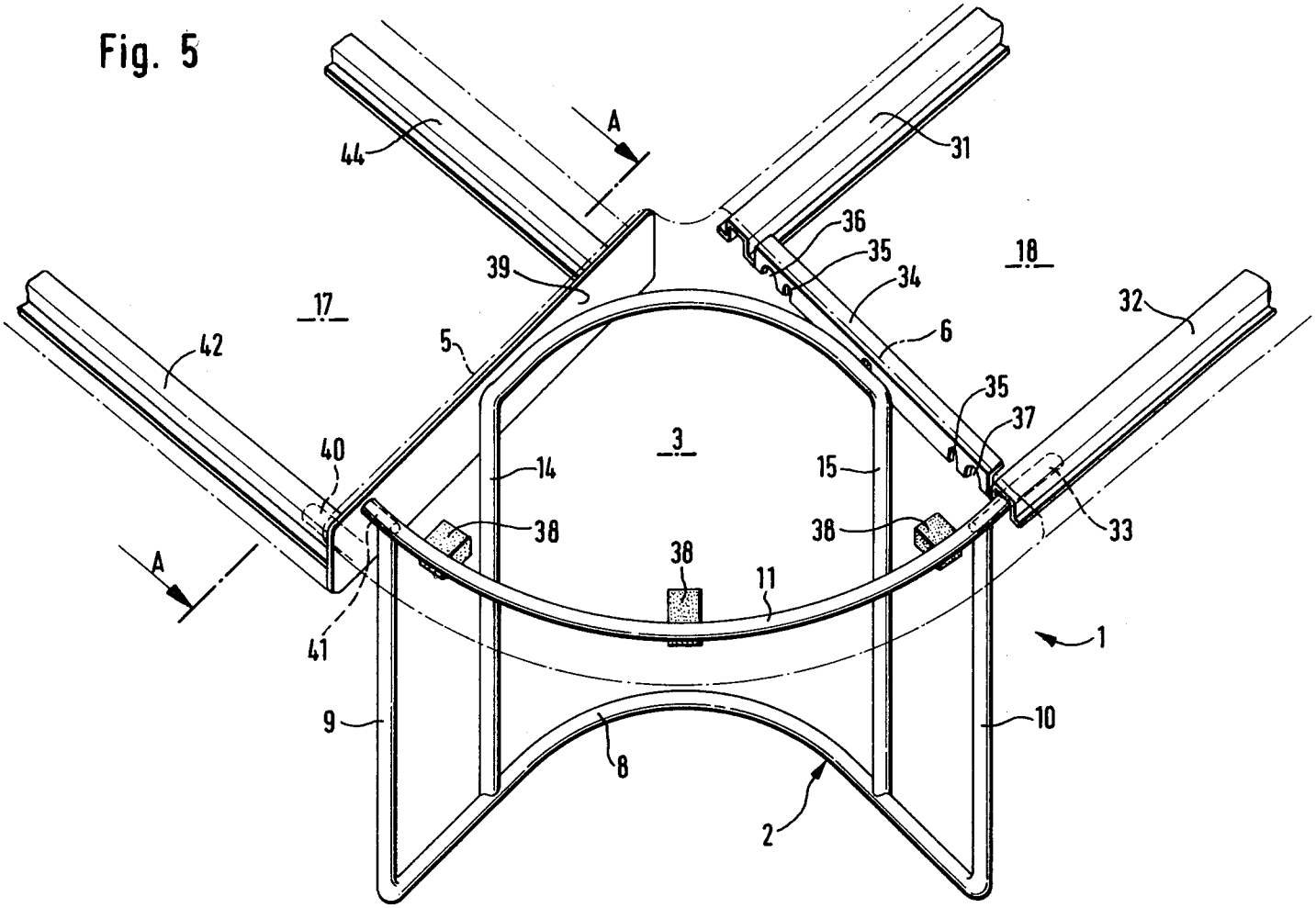

Further features, details and advantages of the invention will be explained with the aid of the drawings, wherein FIG. 1 is a perspective view of a subframe, FIG. 2 is a perspective view of a corner work table with a flush adjoining table top and a lowered adjoining table top, FIG. 3 shows a circular form of a work table consisting of two corner work tables and two corner table tops, FIG. 4 shows the securing of the subframe to the table top, FIG. 5 is a view corresponding to FIG. 2 in which to illustrate the connections the table top has been omitted, FIG. 6 is a sectional view of the table top lowering, FIG. 7 is a view of the table top lowering with a section along the line A—A of FIG. 5, FIG. 8 is a section through the planar connection between a corner table top and an adjoining table top.

FIG. 1 illustrates a corner work table 1, comprising a subframe 2 and a corner table top 3 indicated in dashed line. The corner table top has the form of a quarter circular segment with an edge region with an arcuate portion 4 and two connection sides 5,6. The quarter circular segment of the corner table top 3 does not extend to the tip of the centre of the circle but is cut out also in the form of a quarter circle 7. The length of the sides 5,6 corresponds to the width of the further table tops to be adjoined thereto. It is possible (to form various table shapes) to use non-right-angle circular segments for the corner table top. The exact configuration is apparent from FIG. 4.

The subframe 2 comprises a stirrup member 8 on the floor side, the ends of which extend vertically upwardly and form two corner support legs 9,10. The upper ends of the corner support legs 9,10 are connected by an arcuate support tube 11 which extends parallel to the arc 4 of the corner table top 3. The ends of the support tube 11 are open as insertion sockets 12,13. Substantially beneath the centre of the connection sides two further support legs 14,15 extend vertically downwardly and are connected on the floor side to the member 8. The support legs 14,15 are connected at their upper side by a further support tube 16 which extends arcuately in the direction of the apex of the corner table top 3 and supports this portion of the corner table top. The corner support legs 9 and 10 and the member 8 together with the support legs 14,15 and the support tube 16 are preferably bent from a metal tubular member and welded to give the subframe 2 illustrated. The subframe 2 could however also be made of plastic or wood and of non-tubular parts.

The subframe 2 illustrated is a stable structure having good stability which excellently supports the corner table top 3 in its edge regions and by the insertion sockets 12,13 described in detail below provides a convenient mounting for further table tops to be adjoined thereto. It would be conceivable, instead of the support legs 14,15, to provide only one support leg at the apex of the member 8 substantially beneath the quarter circle 7. This would however largely eliminate the advantageously large foot freedom which a user of the corner work table has from the arc side because a support leg would lie in the direction of the extended feet. The arrangement illustrated of the support legs 14,15 makes it possible for a user to extend his legs past the member 8 as well without restriction. A user from the inside can also extend his legs between the support legs 14,15 without obstruction by a table leg at the pointed side of the corner table top. This makes the usually very uncomfortable corner seats of L or U-shaped conference table arrangements considerably better and they hardly differ in comfort from seats at adjoining straight table tops.

A high proportion of the stability of the corner table 1 is provided by the corner table top 3 after the securing of the latter to the support tubes 11 and 16, and it is therefore not necessary to close the partial frame beneath the corner table top 3 comprising the support tubes 11 and 16. As a result, the subframe 2 can be made very simply and cheaply by bending and welding three circular tube portions.

In FIG. 2 the subframe 2 is shown with fitted corner table top 3 and straight table tops 17,18 adjoining at the connection sides 5,6. The table top 18 is placed flush, i.e. without a step, with the corner table top 3 whilst the table top 17 is in a lowered position compared with the corner table top 3. This lowering is provided in particular for a typewriter location which is lower than the usual work table height. The connection and securing between the table tops is illustrated in FIG. 5 and will be explained in detail here below. FIG. 3 illustrates a circular work table which is made up of two corner work tables 19,20 and two corner table tops 21,22. The corner table tops 21,22 are secured to the corner work tables 19,20 and are thus supported by the two subframes beneath the corner work tables 19,20. Of course, arrangements with four subframes or ¾ circle arrangements are possible, e.g. for enclosing a column.

FIG. 4 shows the edge construction of the corner table top 3 and its securing to the subframe 2 or support tubes 11,16. The corner table top 3 is drawn downwardly at its outer edge 23 in the region of the arcuate portion 4 in the nature of an edge strip to such an extent that the support tube 11, which is held by a holding lug 25, is concealed. Another advantageous result of this is that a user of the corner work table 1 does not come into contact from this outer edge side 23 with any metal of the support tube 11 or the holding lug 23.

The support tube 11 is screwed with the aid of screws 26 from below to the corner table top 3, a washer 27 adapted to the tubular form being inserted as spacer between the corner table top 3 and the support tube 11. The spacer washer 27 serves to bring the support tube 11 into a vertical position, permitting the correct locational introduction into a hat profile section (see FIG. 7) at the flush adjoining table top 18. The support tube 11 is supported towards the edge strip 24 by the holding lug 25, the latter being extended at the same time at the side directed towards the corner table top 3 and bent up at its end. Inserted between this extension 28 and the lower side of the corner table top 3 is a sponge rubber member 29 which fills this space. Between the upper side of the sponge rubber member 29 and the lower side of the corner table top 3 electrical cables 30 may be clamped. This provides on electrification of a corner work table or a table group a clean cable route beneath the corner table top 3 which does not restrict the foot space.

The arrangement shown in FIG. 5 corresponds to that of FIG. 2, the table tops being imagined to have been removed and only indicated in dashed line so that the securing means and the nature of the securing between the table tops can be seen.

Firstly, a flush connection between the corner table top 3 and the table top 18 adjoining on the right will be explained. The table top 18 carries at its two longitudinal sides downwardly open hat profile sections 31,32. The two hat profile sections 31,32 serve, when the table top 18 is not connected to a corner work table 1, for the introduction and holding of leg frames so that the table top 18 can also be used as independent table within the scope of an overall furniture system. In the case illustrated, for securing to the corner work table 1 only the hat profile section 32 is used, into which a support tube section 33 is inserted and clamped in the hat profile section 32 with the aid of holding lugs (not shown). The other side of the support tube section 33 is introduced into the insertion socket 13 of the support tube 11 so that here a stable supporting connection is established. Between the hat profile sections 31,32 an angle rail 34 runs which is screwed from below to the table top 18 and is flush with the latter at the transverse side. This angle rail 34 is provided with securing bores 35. Angle rails are also provided at the connection sides 5,6 of the corner table top 3, but for clarity are shown here in dashed line only at the side 6; the vertical legs of said rails are likewise flush with the sides 5,6 (the section shown in FIG. 4 is behind an angle rail in the direction towards the centre of the corner table top so that said rail is not visible). When the corner table top 3 and the table top 18 are placed together the two angle rails thus bear on each other with their vertical legs so that the securing bores 35 are in alignment. The two angle rails can thus be simply screwed together and this in conjunction with the support tube connection 33 provides an almost smooth, stable and durable connection between the corner table top 3 and the table top 18. At the lower side of the table top 18 along the hat profile sections 31,32 holding lugs are also arranged with sponge rubber members for guiding the cables. For passage of the cables through the angle rails 34 in the lateral regions of said rails recesses 36,37 are provided so that the cables can easily be led further beneath the table tops. The arrangement of the sponge rubber members along the support tube 11 is illustrated in FIG. 5 with three sponge rubber members 38.

The connection between the corner table top 3 and the lowered table top 17 is established by a vertically upright support plate 39 with fitted horizontal support arms 40,41. The support arm 41 is introduced into the insertion socket 12 of the support tube 11, whilst the support arm 40 is inserted into a hat profile section 42 at the lower side of the table top 17. A further support arm 43 (see FIG. 7, concealed in FIG. 5) is inserted into a hat profile section 44 and secured therein by clamping means. The connection to the table top 17 is thus established by the support arms 40,43 clamped to the table top 17. The connection to the corner table top 3 or corner work table 1 is established firstly by the support arm 41 and secondly in that the support plate 39 towards the tip of the corner table top 3 is screwed to the angle rail (not illustrated here) of said table top 3.

In FIG. 6 the support plate 39 is again shown in section with the support arms 40, 41 secured thereto. The vertical offsetting of these two support arms 40,41 corresponds to the height of the lowering of the table top 17 with respect to the corner table top 3.

FIG. 7 shows a diagrammatic sectional representation along the line A—A of FIG. 5. Attached to the support plate 39 are once again the support arms 40,43 which project out of the plane of the drawing. Said support arms 40,43 project into the cut hat profile sections 44 and 42 at the table top 17 (which for clarity have been omitted). The support arms 40,43 are held and clamped in the hat profile sections 42,44 by holding lugs 45,46 screwed thereto. Between the hat profile sections 42,44 the edge angle rail 47 of the table top 17 is illustrated in dashed line.

Thereabove, the connection to the corner work table is illustrated in dashed line. The support arm 41 is in the insertion opening 12 of the support tube 11, the other side of the support plate 39 being secured with the aid of screw means 48 to the angle rail 47, indicated in dashed line, of the corner table top 3.

FIG. 8 again shows the flush connection between the corner table top 3 and the table top 18, the arrangement of the angle rail 34 and an edge-side angle rail 50 at the corner table top 3 with a screw connection 51 being shown in section, the remaining securing members being omitted.

A corner work table has been described which with simple manufacture has good stability and firmness, ensures by the nature of the subframe a high degree of foot freedom and which is well suited as building element for obtaining L and U-shaped table arrangements due to the described simple and rapidly effected connections.

We claim:

1. Corner work table, in particular for office work, comprising a subframe and a corner table top, characterized in that the corner table top (3) has the form of a circular segment having two straight radius sides (5,6) and an arc side (4), that at least in the region of the corners of the corner table top (3) vertically extending support legs (9,10) are disposed, that the support legs (9,10) are connected to the corner table top (3) and to each other at a distance from the corner table top (3) by a member (8) open towards the arc side (4), and that, substantially in the region of the centre of each of the radius sides (5,6) of the corner table (3), a support leg (14,15) is provided, each of said two support legs (14,15) being also connected to the table top (3) and to each other by the member (8) and being connected by a further member (16) which supports the tabletop (3).

2. Corner work table according to claim 1 characterized in that beneath the corner table top (3) along the arc side (4) a support (11) for the table top (3) extends which connects the adjoining support legs (9,10) and provides a supporting surface for the arc side (4) of the corner table top (3).

3. Corner work table according to claim 1 characterized in that the subframe (2) is bent from metal tubing.

4. Corner work table according to claim 1 characterized in that the corner table top (3) is connected to the subframe (2) via holding lugs each of which comprise a freely projecting end not bearing on the corner table top (3) and that the intermediate space between the free holding lug ends and the corner table top (3) has sections of flexible material (29, 38) positioned therein for clamping electrical cables (30).

5. Corner work table according to claim 1, characterized in that at least one radius side (5,6) beneath the corner table top (3) has at least one angle member disposed thereon for connecting the corner table top (3) to a further corner table top (21,22), a table top (17,18) or a side cupboard.

6. Corner work table according to claim 5, characterized in that the angle member is an angle rail (47) which extends over the radius side (5,6), a downwardly directed leg of which is flush with the corner table top (3).

7. Corner work table according to claim 6, characterized in that the angle rail (47) comprises recesses (36,37) for the passage of electric cables and prepared securing bores (35).

8. Corner work table according to claim 1 characterized in that the subframe (2) is made of plastic.

9. Corner work table according to claim 1 characterized in that the subframe (2) is made of wood.

10. Corner work table, in particular for office work, comprising a subframe and a corner table top, characterized in that the corner table top (3) has the form of a circular segment having two straight radius sides (5,6) and an arc side (4), that in the region of two corners of the corner table top (3) vertically extending support legs (9,10,14,15) are disposed, that in the support legs (9,10,14,15) are connected to the corner table top (3) and to each other at a distance from the corner table top (3) by a member (8) open towards the arc side (4), and that a support (11), having insertion openings or sockets (12,13) at its ends extends along the arc side (4) beneath the corner table top (3), connects the adjoining support legs (9,10), and provides a supporting surface for the arc side (4) of the corner table top (3).

11. Corner work table according to claim 10 characterized in that the subframe (2) is bent from metal tubing.

12. Corner work table according to claim 10 characterized in that the subframe (2) is made of plastic.

13. Corner work table according to claim 10 characterized in that the subframe (2) is made of wood.

14. Corner work table according to claim 10 characterized in that the corner table top (3) is connected to the subframe (2) via holding lugs each of which comprise a freely projecting end not bearing on the corner table top (3) and that the intermediate space between the free holding lug ends and the corner table top (3) has sections of flexible material (29,38) positioned therein for clamping electrical cables (30).

15. Corner work table according to claim 10 characterized in that at least one radius side (5,6) beneath the corner tabletop (3) has at least one angle member disposed thereon for connecting the corner table top (3) to a further corner table top (21,22), to a table top (17, 18) or to a side cupboard.

16. Corner work table according to claim 15 characterized in that the angle member is an angle rail (47)

which extends over the radius side (5,6), a downwardly directed leg of which is flush with the corner table top (3).

17. Corner work table according to claim 16 characterized in that the angle rail (47) has recesses (36, 37) for the passage of electric cables and securing bores (35).

18. Corner work table, in particular for office work, comprising a subframe and a corner table top, characterized in that the corner table top (3) has the form of a circular segment having two straight radius sides (5,6) and an arc side (4), that in the region of two corners of the corner table top (3) vertically extending support legs (9,10,14,15) are disposed, that the support legs (9,10,14,15) are connected to the corner table top (3) and to each other at a distance from the corner table top (3) by a member (8) open towards the arc side (4), and that for lowering of a table top (17) adjoining the corner work table (1) a vertical support plate (39) is provided along at least one radius side (5) of the corner tabletop (3) and comprises securing means (40,41) extending toward the corner table top (3) and extending toward the adjoining table top (17) for providing support means for a lowered adjoining table top (17) and the securing means (40,41) are disposed at different heights corresponding to the desired lowering of the adjoining table top (17) on the support plate (39).

19. Corner work table according to claim 18 characterized in that beneath the corner table top (3) along the arc side (4), a support (11) for the table top (3) extends which connects the adjoining support legs (9,10) and provides a supporting surface for the arc side (4) of the corner table top (3).

20. Corner work table according to claim 18 characterized in that the subframe (2) is bent from metal tubing.

21. Corner work table according to claim 18 characterized in that the subframe (2) is made of plastic.

22. Corner work table according to claim 18 characterized in that the subframe (2) is made of wood.

23. Corner work table according to claim 18 characterized in that the corner table top (3) is connected to the subframe (2) via holding lugs which comprise a freely projecting end not bearing on the corner table top (3) and that the intermediate space between the free holding lug ends and the corner table top (3) has sections of flexible material (29, 38) positioned therein for clamping electrical cables (30).

24. Corner work table according to claim 18 characterized in that at least one radius side (5,6) beneath the corner tabletop (3) has at least one angle member disposed thereon for connecting the corner table top (3) to a further corner table top (21,22), to a table top (17,18) or to a side cupboard.

25. Corner work table according to claim 24 characterized in that the angle member is an angle rail (47) which extends over the radius side (5,6), a downwardly directed leg of which is flush with the corner table top (3).

26. Corner work table according to claim 25 characterized in that the angle rail (47) has recesses (36, 37) for the passage of electric cables and securing bores (35).

27. Corner work table, in particular for office work, comprising a subframe and a corner table top, characterized in that the corner table top (3) has the form of a circular segment having two straight radius sides (5,6) and an arc side (4), that in the region of two corners of the corner table top (3) vertically extending support legs (9,10,14,15) are disposed, that the support legs (9,10,14,15) are connected to the corner table top (3) and to each other at a distance from the corner table top (3) by a member (8) open towards the arc side (4), that beneath the corner table top (3) along the arc side (4), a support (11) for the table top (3) extends which connects the adjoining support legs (9,10) and provides a supporting surface for the arc side (4) of the corner table top (3), and in that securing means for securing the corner table top (3) to an adjacent table top (17) are provided and comprise a support arm (41) which extends toward the corner table top (3) and is insertable into an insertion opening (12,13) of the support (11) and into a screw connection (48) to an angle rail (47) and further comprise two support arms (40,43) which extend toward the adjoining table top (17) and which are insertable in two longitudinal profile sections (42,44) on the table top (17).

28. Corner work table according to claim 27 characterized in that the subframe (2) is bent from metal tubing.

29. Corner work table according to claim 27 characterized in that the subframe (2) is made of plastic.

30. Corner work table according to claim 27 characterized in that the subframe (2) is made of wood.

31. Corner work table according to claim 27 characterized in that the corner table top (3) is connected to the subframe (2) via holding lugs each of which comprise a freely projecting end not bearing on the corner table top (3) and that the intermediate space between the free holding lug ends and the corner table top (3) has sections of flexible material (29, 38) positioned therein for clamping electrical cables (30).

32. Corner work table according to claim 26 characterized in that at least one radius side (5,6) beneath the corner tabletop (3) has at least one angle member disposed thereon for connecting the corner table top (3) to a further corner table top (21,22), to a table top (17, 18) or to a side cupboard.

33. Corner work table according to claim 32 characterized in that the angle member is an angle rail (47) which extends over the radius side (5,6), a downwardly directed leg of which is flush with the corner table top (3).

34. Corner work table according to claim 33 characterized in that the angle rail (47) has recesses (36, 37) for the passage of electric cables and securing bores (35).

35. Corner work table, in particular for office work, comprising a subframe and a corner table top, characterized in that the corner table top (3) has the form of a circular segment having two straight radius sides (5,6) and an arc side (4), that in the region of two corners of the corner table top (3) vertically extending support legs (9,10,14,15) are disposed, that the support legs (9,10,14,15) are connected to the corner table top (3) and to each other at a distance from the corner table top (3) by a member (8) open towards the arc side (4), that beneath the corner table top (3) along the arc side (4), a support (11) for the table top (3) extends which connects the adjoining support legs (9,10) and provides a supporting surface for the arc side (4) of the corner table top (3), and that for the flush connection of a table top (18) to a corner work table (1) a support arm section (33) is provided which can be inserted into an opening (13) of the support (11) and into a longitudinal profile section (32) of the table top (18).

36. Corner work table according to claim 35 characterized in that the subframe (2) is bent from metal tubing.

37. Corner work table according to claim 35 characterized in that the subframe (2) is made of plastic.

38. Corner work table according to claim 35 characterized in that the subframe (2) is made of wood.

39. Corner work table according to claim 35 characterized in that the corner table top (3) is connected to the subframe (2) via holding lugs each of which comprises a freely projecting end not bearing on the corner table top (3) and that the intermediate space between the free holding lug ends and the corner table top (3) has sections of flexible material (29, 38) positioned therein for clamping electrical cables (30).

40. Corner work table according to claim 35 characterized in that at least one radius side (5,6) beneath the corner tabletop (3) has at least one angle member disposed thereon for connecting the corner table top (3) to a further corner table top (21,22), to a table top (17, 18) or to a side cupboard.

41. Corner work table according to claim 40 characterized in that the angle member is an angle rail (47) which extends over the radius side (5,6), a downwardly directed leg of which is flush with the corner table top (3).

42. Corner work table according to claim 41 characterized in that the angle rail (47) has recesses (36, 37) for the passage of electric cables and securing bores (35).

* * * * *